US006240844B1

(12) United States Patent
Flosenzier et al.

(10) Patent No.: US 6,240,844 B1
(45) Date of Patent: Jun. 5, 2001

(54) METHOD FOR SPECIFYING ENGRAVING OF A GRAVURE CYLINDER FOR COATINGS CONTAINING PARTICLE DISPERSIONS

(75) Inventors: Linda S. Flosenzier, Rochester; Jacob J. Hastreiter, Jr., Spencerport, both of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/563,144

(22) Filed: May 2, 2000

(51) Int. Cl.[7] ..... B41C 1/00

(52) U.S. Cl. ..... 101/401.1; 219/121.69; 430/307

(58) Field of Search ..... 101/401.1, 395, 101/3.1; 219/121.68, 121.69; 356/379; 358/298, 299; 430/322, 323, 307, 327

(56) References Cited

U.S. PATENT DOCUMENTS 4,841,611 * 6/1989 Kusaba et al. ..... 29/121.2
4,939,994 * 7/1990 Puleston ..... 101/401.1
5,126,531 * 6/1992 Majima et al. ..... 219/121.68
5,426,588 6/1995 Walters et al. .
5,427,026 * 6/1995 Kuwahara ..... 101/401.1

FOREIGN PATENT DOCUMENTS 9323482 12/1997 (JP) .

* cited by examiner

*Primary Examiner*—Ren Yan
(74) *Attorney, Agent, or Firm*—Clyde E. Bailey, Sr.

(57) ABSTRACT

A method of engraving a gravure cylinder having a circumference C for coating a liquid composition on a substrate. The liquid composition contains a concentration of particles having a predetermined particle diameter. The method includes calculating the engraving channel depth $D_o$ based on a first ratio of the particle diameter to channel depth ($D_B/D_o$). Then, engraving the gravure cylinder according to $\theta$, $\alpha$, $W_C$, $W_w$, and $W_o$.

8 Claims, 2 Drawing Sheets

METHOD FOR SPECIFYING ENGRAVING OF A GRAVURE CYLINDER FOR COATINGS CONTAINING PARTICLE DISPERSIONS

FIELD OF THE INVENTION

The invention relates generally to the field of gravure coating, and in particular, to controlling gravure cylinder engraving. More specifically, the invention relates to a method for specifying an electromechanical cylinder engraving for coatings containing particles in order to provide improved imaging quality.

BACKGROUND OF THE INVENTION

Gravure cylinders are used for coating liquid compositions on moving supports. The amount of liquid deposited by the gravure cylinder is a function of the recessed cells on the surface of the cylinder. A typical design used in an engraving for the gravure cylinder has been reliance on a large inventory of finished cylinders having different engraved cell patterns, sizes and shapes. The proper lay down of the liquid coating composition is determined empirically, by either trying a number of cylinders, or using cylinders that worked previously. Although somewhat successful, the shortcomings of this method are the reliance upon empirical experimentation and the ability of a single source engraver service to make it "like another cylinder." The engraver would empirically change the cell depth to increase or decrease fluid deposit lay down with a minimum concern for cell geometry effect on coating quality.

U.S. Pat. No. 5,426,588, hereby incorporated herein by reference, discloses a process of electromechanical engraving and a method for specifying cell geometry and engraving process setup conditions based on a cell volume model. In accordance with the aforementioned method, a skilled artisan can specify to an engraver the proper parameters needed to engrave a cylinder that will produce the desired coating coverage. Using these guidelines it is possible to specify an engraving process that will yield good coating quality for formulations which do not contain particulate material, such as beads. However, when gravure coatings containing particulate materials are used in low gloss printing applications, the method described in U.S. Pat. No. 5,426,588 is not sufficient to predict acceptable coating or imaging performance.

A particular problem with coating formulations containing particles, such as beads, which are dispersed but not dissolved in the formulation is that the particles can interact with the engraving process in such a manner that the expected good coating quality is not achieved. One such coating formulation is disclosed in Japanese Kokai [1997]-323482. According to this Japanese Kokai, the use of imaging-protecting layers that contain thermally expandable micro-capsules for "easy matting" of the image surface are described. When micro-capsules such as these are used a more severe problem can occur in gravure coated image protecting layers where an objectionable image artifact can be observed based on an interference pattern which results when the light source orientation and the coating direction of the protecting layer coincide. This artifact can be eliminated and the gloss position can be improved by specifically defining the engraving dimensions for the gravure cylinder with respect to the particle size range being used in the formulation.

Therefore, there exists a need in the art for a modified method for specifying engraving parameters which takes into account the specific size range of the beads or particles that are in the coating formulation.

SUMMARY OF THE INVENTION

It is, therefore, an object of the invention to provide a method for specifying engraving using a coating composition containing particulate matter.

Another object of the invention is to provide a modified method for specifying the engraving such that the ratio of particulate size in the formulation to channel depth in the engraving is defined.

The present invention is directed to overcoming one or more of the problems set forth above. Briefly summarized, according to one aspect of the present invention, a method of engraving a gravure cylinder having a circumference (C) for coating a liquid composition on a substrate, said liquid composition containing a concentration of particles having a predetermined particle diameter, said method comprising the steps of:

(a) determining a coverage VA, of the liquid composition on the substrate;

(b) selecting a stylus angle $\theta$;

(c) selecting a compression angle $\alpha$;

(d) specifying a first ratio ($D_B/D_o$) of said predetermined particle diameter $D_B$ to an engraving channel depth $D_o$;

(e) calculating said engraving channel depth $D_o$ based on said first ratio ($D_B/D_o$) and said predetermined particle diameter $D_B$.

(f) specifying a second ratio ($W_w/W_o$) of a wall width $W_w$ to cell width $W_o$;

(g) calculating a channel width $W_c$ according to equation $$W_c=[2 \tan \theta/2]D_o$$

(h) calculating the cell width $W_o$ according to the equation $$VA=[1122.5/(\tan \theta/2)]*[3W_o^2+2W_oW_c+3W_c^2]*[(\sqrt{2})/X]$$

wherein $$X=W_o+W_c+2W_w;$$

(i) calculating the wall width $W_w$ based on the second ratio; and, (j) engraving the gravure cylinder according to $\theta$, $\alpha$, $W_c$, $W_w$, and $W_o$.

The present invention has numerous important advantages over the prior art including: it enables the optimization of image gloss level; and, it produces an image free of light interference artifacts.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

DETAILED DESCRIPTION OF THE INVENTION

The electromechanical engraving machine in its simplest form has three basic parts: a scanning head; a control panel/processing unit and power supply; and an engraving head and cylinder station. To make an engraving, a photographic print is mounted upon the scanning drum, simple patterns can be directly computer programmed, and a blank copper plated and polished cylinder is placed onto the engraving station. The cylinder to be engraved revolves at a synchronized speed with the scanner drum. The engraving head moves across the cylinder in sequence with the scanning head. It reads the information on the photographic print and transmits the information to a central processor unit that modifies and forwards the signals to the engraving head. The engraving head responds by thrusting a pyramid shaped diamond stylus into the soft copper to engrave a discreet cell. The size of the cell is controlled by the electronics and the dimensions of the diamond stylus. The narrower the point of the diamond, the smaller the stylus angle. Cell depth variations are controlled by modulating the strength of the signal sent to the engraving head. The stylus itself vibrates at a constant speed and amplitude. By varying the electric current the signal moves the stylus assembly in and out of the copper surface, engraving a recessed cell to a depth proportional to the signal voltage. A channel is formed by incomplete withdrawal of the diamond cutting stylus, forming linkage between the individual cells. Recent software and internal electronic circuitry improvements make it possible to control cell engraving digitally. It is important that the digitized signal contain all the information to be engraved because cell characteristics are programmable on the machine and are independent of the blank base cylinder material, typically copper. After engraving, the cylinder is deburred and buffed. The cylinder is then chrome-plated, cross-hatched and polished. It should be appreciated that the chrome-plating has a unique set of processing variables that can and probably does effect the final cell volume.

Because of the importance and complexity of the engraving process, empirical relationships that describe the dependence of cell geometry characteristics on engraving process specifications and control parameters exist. A cell volume model is derived in terms of simple geometry mathematics and expressed in terms that control the digitized input to an electromechanical engraving machine. The model does not account for cylinder processing steps after engraving. However, the relative calculated volume does agree with observed thermal dye sublimation formulations and print lay down fluid deposit density. It is our experience that cell-shaped characteristics dramatically effect the coating quality uniformity.

Figure 1:
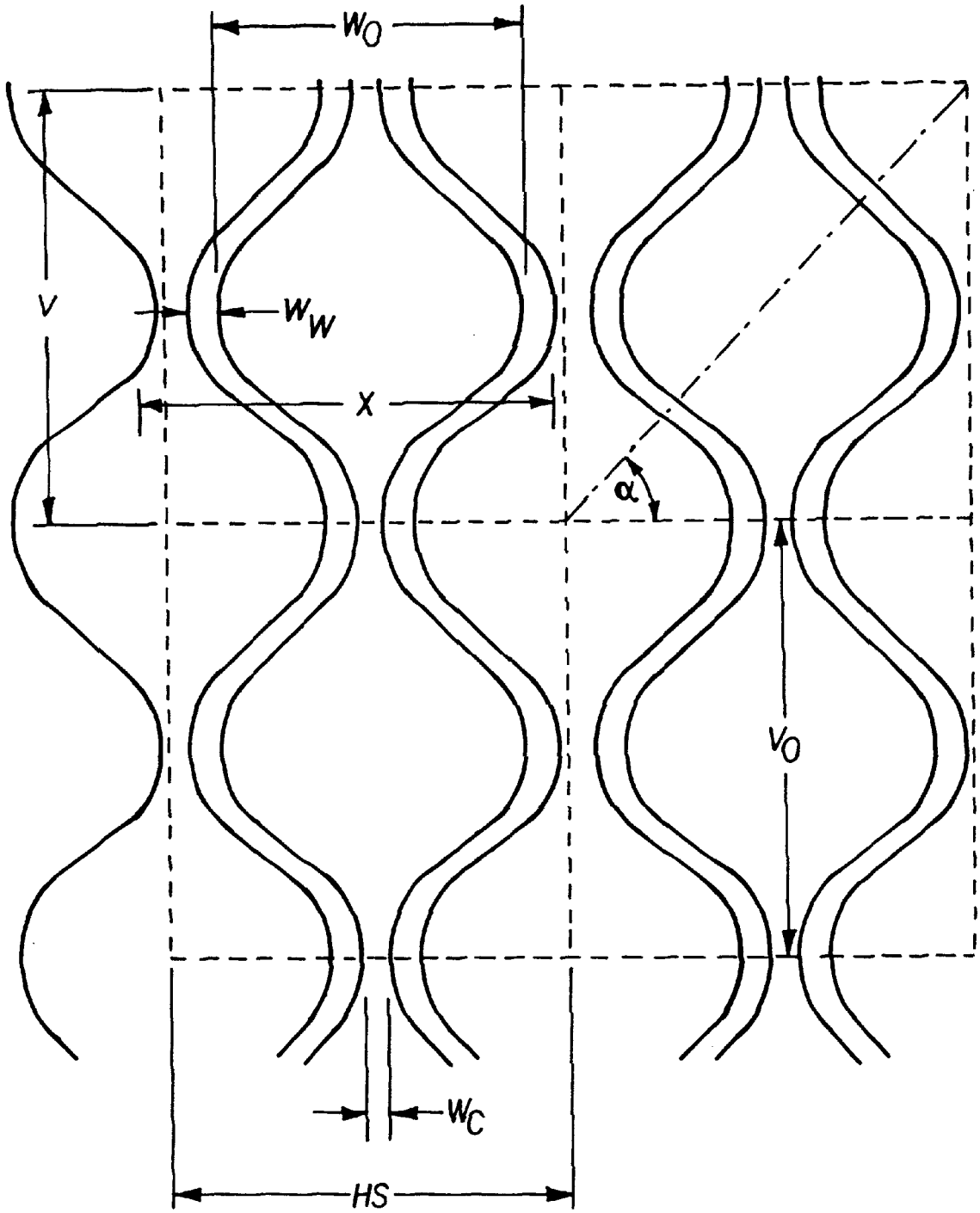
FIG. 1 is a diagram of the engraving pattern produced by an electromechanical engraving machine.

Electromechanical engraving machines produce high quality gravure cylinders. An engraved normal cell from an electromechanical engraving machine is shown in FIG. 1. A single cell is characterized by dimensions of cell width ($W_o$) as measured at the inside wall of the cell and the cell height ($V_o$). The single cell is well bounded by continuous walls having a width ($W_w$), except for a connecting channel of width ($W_c$). The individual cells are most often connected by an axial channel. The single cell is normally nested into an ordered array to form a very large cell population density. Tradition has maintained definition of the cell count within the array by drawing an imaginary screen around the individual cell as shown by the dotted lines.

Figure 2:
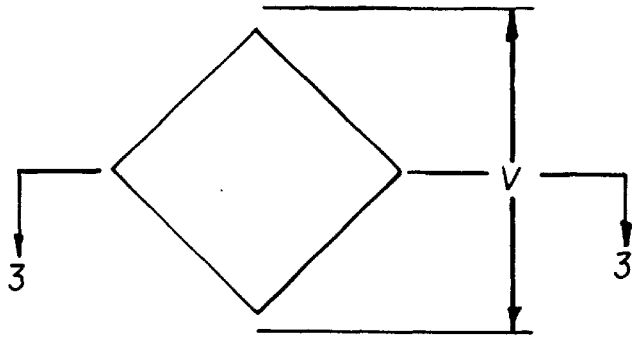
FIG. 2 (PRIOR ART)
FIG. 2 shows a simplified version of an electromechanically engraved cell.

The derivation for determining volume per unit area (VA) is shown below. To simplify the calculation, a diamond is used to approximate the wall bound of an electromechanically engraved cell. Plain geometry dimensions on the resulting simplified cell are shown in FIG. 2. The height is a function of the engraved cell vertical line screen (VS) dimension as, 1/(V) (in lines/$\mu$m).

Figure 3:
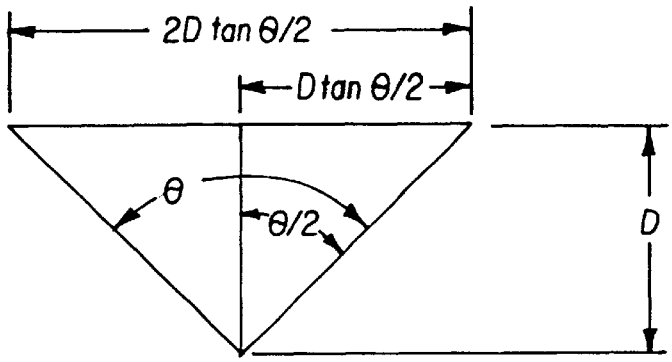
FIG. 3 (PRIOR ART)
FIG. 3 is a view along line III—III of FIG. 2.

A bisection of the simplified cell in its axial direction along the line III—III is shown in FIG. 3. According to FIG. 3, the engraving diamond stylus cuts into the copper to depth D, and has an included stylus angle θ.

Figure 4:
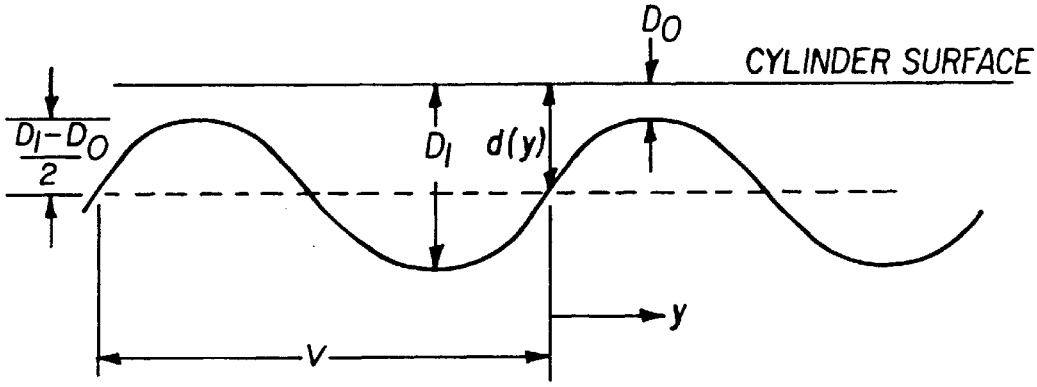
FIG. 4 (PRIOR ART)
FIG. 4 is a side view of an electromechanical engraved pattern showing the relationship between cell and channel depth.

Cutting the cell circumferentially along the vertical line screen midpoint of the engraving direction and looking at the cell from the side, FIG. 4 shows the cell geometry left by the in and out stroke of the engraving stylus as it engraves in the y direction. The depth of the stylus entry into the cylinder surface, is $D_I$. The channel is formed by the incomplete withdrawal of the stylus. One period of engraving corresponding to the cell from midpoint channel to midpoint channel, i.e., height, is 1/(VS).

The cell width at any axial point along the engraving is W(y)=2D tan/2, the maximum cell width is therefore 2d tan/2. Where $$d = D_0 + \frac{(D_1 + D_0)}{2} - \frac{D_1 - D_0}{2}\sin\left(\frac{2\pi}{V_y}\right)$$

The connecting channel would have the same shape as the cell at its depth, $D_o$, but less deeply cut than the cell. Therefore the geometry of the channel is proportional to the geometry of the cell and mathematically described by the following:

$$D_o/D_I = W_c/W_o$$

The stylus angle dictates the geometry of the cell and channel as follows:

$$D_I = W_o/2 \tan(\theta/2)$$

$$W_c = [2 \tan(\theta/2)]D_o$$

The area of the triangle looking into the front view of the cell is $$\text{area} = \tfrac{1}{2}(d)(2d \tan \theta/2)$$

$$= d^2 \tan \theta/2$$

The volume of an individual normal cell having compressing angle equal to 45 is found by integrating in the machine engraving direction (y), along the vertical line screen. Algebraically, this relationship converts to:

$$\text{volume/cell} = \frac{V}{32 \tan\theta/2}(3W_0^2 + 2W_0W_c + 3W_c^2) \quad (1)$$

The horizontal repeat length X, is the width across one electromechanical cell that comprises the cell width, two wall widths and a channel width.

$$X = W_o + W_c + 2W_w \quad (2)$$

The horizontal and vertical screens (HS and VS) are defined as:

$$HS = \frac{1}{X} \quad (3)$$

$$VS = \frac{1}{V}$$

According to the Ohio engraver's definition, however, the horizontal and vertical screens defined in Equation 3 are both multiplied by 2. The actual screen (AS), is the square root of the reciprocal of the area per unit cell (screen population).

$$AS = \sqrt{\frac{2}{XV}} \tag{4}$$

The horizontal and vertical repeats are related by the compression angle. Alternatively, the horizontal and vertical screens can also be calculated from the actual screen and compression angle using the following equations:

$$\tan\alpha = \frac{HS}{VS} = \frac{V}{X} \tag{5}$$

$$HS = \frac{AS * \sqrt{\tan\alpha}}{\sqrt{2}} \tag{6}$$

$$VS = \frac{AS}{\sqrt{\tan\alpha} * \sqrt{2}}. \tag{7}$$

Since, $$\text{vol/area} = \text{vol/cell} \times \left(\frac{\text{cell}}{\text{area}}\right) \text{ or } AS^2 \tag{8}$$

Substituting Equation 1 into Equation 8 and converting to square inches yields ##

$$\text{volume/sq. inch} = \frac{1122.5}{\tan\frac{\theta}{2}}(3W_0^2 + 2W_0W_c + 3W_c^2)HS \tag{9}$$

where the stylus angle (θ), compression angle (α), the channel width, wall width, and cell width are used to calculate and determine the total engraving pattern geometry and the engraving machine settings. For example, engraver vertical setting is a variable that is specified for an Ohio engraving machine. For an Ohio engraving machine the engraver vertical setting (N2) can be calculated by:

$$N_2 = \frac{\text{Circumference} * \text{Desired vertical screen}}{7.5} \tag{10}$$

(7.5 is the Ohio engraving machine constant). The engraver usually defines the vertical and horizontal screen by multiplying the actual vertical and horizontal screens by √2. Hence, they would calculate N2 by dividing the right hand side of Equation 10 by √2.

In previous methods for specifying an engraving, the preferred ranges for engraving parameters were determined based on the capabilities of the engraving machine and the predetermined relationship between these parameters and general coating quality of typical gravure coating solutions. These methods did not depend on any specific attribute of the coating solution itself.

In contradistinction, when using coating formulations that contain particles, such as beads, the method of the present invention for specifying an engraving of a gravure cylinder requires the following steps:

(a) Determining the required coverage, in cc per square foot, based on density specifications of the product. Standard density versus lay down calibrations is usually available for each product. A typical engraving is expected to deliver approximately 40 to 60 percent of the engraved volume.

(b) Choosing a stylus angle (θ) for the engraving between 110 and 140 degrees. Note that for a given volume per unit area a smaller stylus usually implies finer screen count that will take longer to engrave and, therefore, be more expensive.

(c) Choosing a compression angle (α). Experimental studies have shown that smaller compression angles coat more uniformly, particularly with solvent solutions. Engravings done with a compression angle less than 38 degrees, however, are difficult to engrave and are not usually very uniform.

(d) Specifying the ratio ($D_B/D_o$) of a known particle diameter to engraving channel depth. When the coating formulation contains dispersed beads or particulates the relationship between the particulate characteristic length or diameter ($D_B$) and the engraving geometry, specifically the channel depth ($D_o$) must be optimized for either good coating quality and/or optimal image appearance in the case of an image protecting layer. The preferred ratios are $D_B/Do>1.1$ or $D_B/Do<0.5$.

(e) Calculating the engraving channel depth Do from the known particle diameter and the specified ratio ($D_B$/Do).

(f) Determining the wall width to cell width ratio, $W_w/W_o$. The limits for this ratio are roughly between 10 and 20 percent. Ratios less than 10 percent results in very thin walls and can result in blown out walls. On the other hand, ratios greater than 25 percent results in printing of the cell patterns, especially with solutions having viscosities higher than about 40 centipoise. The most preferred value is approximately 15 percent.

(g) Calculating the channel width Wc according to:

$$W_c=[2 \tan (\theta/2)]D_o$$

(h) Calculating the cell width using the specified information, the calculated channel width and the following equations:

$$VA=[1122.5/(\tan \theta/2)]*[3W_o^2+2W_oW_c+3W_c^2]*[(\sqrt{2})/X]$$

wherein $$X=W_o+W_c+2W_w;$$

The cell width can then be calculated by substituting the channel width and the wall width to cell width ratio into the horizontal repeat length (Equation 2). The relationship of cell width to repeat length along with stylus angle and engraved volume are substituted into the volume equation (Equation 9).

(i) Calculating the wall width is calculated from the ratio defined above and the cell width.

(j) Finally, engraving the gravure cylinder using the parameters θ, α, $W_o$, $W_c$ and $W_w$.

For an Ohio engraving machine the following additional manipulations are undertaken:

(k) The horizontal repeat length is calculated using Equation 2 above.

(l) The horizontal screen count is calculated by substituting the value of the horizontal repeat length in Equation 3 above.

(m) The actual screen count is now calculated from the horizontal screen and the compression angle by rearranging Equation 6 above.

(n) The vertical screen is now calculated from the actual screen count by rearranging Equation 7 above.

(o) The engraving vertical setting is calculated from the given cylinder circumference using equation 10 above.

(p) Then, engraving the gravure cylinder according to $N_2$ and θ.

EXAMPLE

Calculation for a coverage requirement of 0.63 cc/ft$^2$ to meet a required lay down specification for a formulation containing particulates with a 6 μm diameter may be undertaken in accordance with the following steps:

(1.) Assuming 50 percent transfer efficiency the engraved volume would be 1.25 cc/ft$^2$.

(2) Choosing a stylus angle θ of 120 degrees.

(3) Choosing a compression angle α of 40 degrees.

(4) Choosing a ratio ($D_B/D_o$) of a known particle diameter to engraving channel depth. A value of 1.2 is within the preferred range.

(5) The recommended wall to cell width ratio ($W_w/W_o$) is 0.15 percent.

(6) Calculating the engraving channel depth Do from the known particle diameter and the specified ratio ($D_B$/Do). Do=6 μm/1.2=5 μm (7) Calculating the channel width Wc according to:

$$W_c=[2\tan(\theta/2)]Do=17.3\ \mu m$$

(8) The cell width can now be calculated using Equation 9. (The wall width can be written in terms of the cell width using the ratio defined above.) From Equation 2, substituting values into equation 9, $$1.25=[1122.5/(\tan\theta/2)]*[3W_0^2+2W_0*17.3+3(17.3)^2]*\left[\frac{\sqrt{2}*25400}{(1.3W_0+17.3)}*\frac{144}{10^{12}}\right]$$

$$W_o=161\ \mu m$$

(9) The wall width is then determined from the defined ratio.

$$W_w=0.15\times161=24\text{ microns}$$

(10) The horizontal repeat length (from Equation 2)

$$X=W_o+W_c+2W_w=226\text{ microns}$$

(11) The horizontal screen (Equation 3)

$$HS=1/226\times25400=112\text{ lpi (lines per inch)}$$

(Note: Ohio engraver horizontal screen=√2*112=158 lpi)

(12) The actual or line screen can be calculated using Equation 6.

$$AS=\frac{\sqrt{2}*112}{\sqrt{\tan40}}$$

(13) Using Equation 5, the vertical repeat length can be calculated.

$$V=226*\tan40^\circ=189\text{ microns}$$

And the vertical screen (Equation 3)

$$VS=\frac{1}{189}*25400$$

$$VS=134\text{ lpi}$$

(Note: Engraver vertical screen √2*134=190 lpi)

(14) The engraver vertical setting (N2) for a cylinder having a 10 inch diameter is then determined $$N_2=\frac{10.0*\pi*134}{7.5}$$

$$N_2=561$$

Cylinders engraved using the above design guidelines, which take into account the specifics of the material components of a possible coating formulation (namely particle diameter) provide engraving dimension specifications for improved coating and particularly imaging quality. Cylinders engraved by prior art design methods do not reliably produce acceptable coating or image quality. A comparison was made using 3 coating Dispersions containing particulates of different sizes, Dispersion A used particles with a defined polydisperse size range, Dispersions B and C used mono-dispersed particles. Five different cylinder engravings were used for coating and the samples were evaluated for coating and imaging quality. Cylinders #K38 and #17 were designed according to the method outlined in the above embodiment, cylinders #K36, #16 and #18 were designed using prior art methods.

Referring to Table I, the coating quality and image quality achieved with respect to the preferred design criteria of the current invention are compared with the prior art. In the present invention it was found that the image quality strongly depended on the ratio of bead size to channel depth $D_B/D_o$. There was also a dependence of the coating quality on this criteria. In prior art (U.S. Pat. No. 5,426,588) the ratio of channel width to cell width, $W_c/W_o$ was claimed as being an important criteria for coating quality, with a preferred range of $W_c/W_o$ from 0.15 to 0.30.

TABLE 1

| Coating Disp | Cyl | Invention Criteria $D_B/D_o$ | Prior Art Criteria Wc/Wo | Coating Quality | Image Quality |
|---|---|---|---|---|---|
| A | #K38 | 1.5–2.25 | 0.09 | light streaks | Good |
| A | #17 | 1.2–1.8 | 0.11 | heavy streaks | Good |
| A | #16 | 1.3–0.9 | 0.15 | heavy streaks | Slight interference pattern |
| A | #K36 | 0.6–1.0 | 0.19 | heavy streaks | Significant interference pattern |
| A | #18 | 0.5–0.7 | 0.22 | heavy streaks | Significant interference pattern |
| B | #K36 | 0.4 | 0.19 | very light streaks | Good |
| B | #18 | 0.3 | 0.22 | no streaks | Good |
| C | #16 | 2.9 | 0.15 | no streaks | |

As depicted in Table 1, for coatings containing dispersed beads or particulates the specification of $W_c/W_O$ is not a sufficient parameter to design an engraving for acceptable coating quality. At the same ratio of $W_c/W_o$, one formulation has good coating quality as predicted but another formulation has unacceptable coating quality. Coating quality is also not necessarily predictive of imaging quality. In thermal dye sublimation imaging systems the imaging quality is more important than the coating quality and neither the coating quality nor the ratio of channel width to cell width, $W_c/W_o$, reliably predict the imaging quality. The ratio of bead size to channel depth $D_B/D_o$ is predictive of imaging quality. The aspect of image quality is more important when these types of coatings are used in thermal dye sublimation imaging systems and the image quality is shown to be strongly dependent on the ratio of bead size to channel depth $D_B/D_o$. Using only the design criteria and method of the prior art, without including the impact of the particulates in the formulation will not reliably provide acceptable coatings or imaging layers. Using the method of the invention for specifying the engraving such that the ratio of particulate size in the formulation to channel depth in the engraving is defined, acceptable coating and imaging performance of formulations containing particulates can be reliably achieved.

The invention has been described with reference to a preferred embodiment. However, it will be appreciated that variations and modifications can be effected by a person of ordinary skill in the art without departing from the scope of the invention.

What is claimed is:

1. A method of engraving a gravure cylinder having a circumference C for coating a liquid composition on a substrate, said liquid composition containing a concentration of particles having a predetermined particle diameter, said method comprising the steps of:

(a) determining a coverage VA, of the liquid composition on the substrate;

(b) selecting a stylus angle θ;

(c) selecting a compression angle α;

(d) specifying a first ratio ($D_B/D_o$) of said predetermined particle diameter $D_B$ to an engraving channel depth $D_o$;

(e) calculating said engraving channel depth $D_o$ based on said first ratio ($D_B/D_o$) and said predetermined particle diameter $D_B$;

(f) specifying a second ratio ($W_w/W_o$) of a wall width $W_w$ to cell width $W_o$;

(g) calculating a channel width $W_c$ according to equation $$W_c=[2 \tan \theta/2]D_o$$

(h) calculating the cell width $W_o$ according to the equation $$VA=[1122.5/(\tan \theta/2)]*[3\ W_o^2+2\ W_oW_c+3\ W_c^2]*[(\sqrt{2})/X]$$

wherein $X=W_o+W_c+2W_w$;

(i) calculating the wall width $W_w$ based on the second ratio; and, (j) engraving the gravure cylinder according to θ, α, $W_c$, $W_w$, and $W_o$.

2. The method according to claim 1 wherein the first ratio is less than 0.5 or greater than 1.1.

3. The method according to claim 1 wherein said particles have a predetermined diameter in the range of 1 micron to about 25 microns.

4. The method according to claim 1 wherein said particles have a predetermined diameter in the range of 6 microns to 16 microns.

5. A method for engraving a gravure cylinder having a circumference C for coating a liquid composition on a substrate, said liquid composition having a concentration of particles having a predetermined particle diameter, said method comprising the steps of:

(a) determining a coverage VA of the liquid composition on the substrate;

(b) selecting a stylus angle θ;

(c) selecting a compression angle α;

(d) specifying a first ratio ($D_B/D_o$) of said predetermined particle diameter $D_B$ to an engraving channel depth $D_o$;

(e) calculating said engraving channel depth $D_o$ based on said first ratio ($D_B/D_o$) and said predetermined particle diameter $D_B$;

(f) specifying a second ratio ($W_w/W_o$) of a wall width $W_w$ to cell width $W_o$;

(g) calculating a channel width $W_c$ according to equation $$W_c=[2 \tan \theta/2]D_o$$

(h) calculating the cell width $W_o$ according to the equation $$VA=[1122.5/(\tan \theta/2)]*[3\ W_o^2+2\ W_oW_c+3\ W_c^2]*[(\sqrt{2})/X]$$

wherein $X=W_o+W_c+2W_w$;

(i) calculating the wall width $W_w$ based on the second ratio;

(j) calculating engraving parameter according to θ, α, $W_c$, $W_w$, and $W_o$ (k) calculating the horizontal repeat length X according to:

$$X=W_o+W_c+2W_w;$$

(l) calculating a horizontal screen (HS) according to:

$$HS=\sqrt{2}/X$$

(m) calculating a line screen according to:

$$AS=HS\sqrt{2}/\sqrt{\tan \alpha}$$

(n) calculating a vertical screen (VS) count according to:

$$VS=AS/(\sqrt{\tan \alpha}*\sqrt{2});$$

(o) calculating an engraver vertical setting $N_2$ according to:

$$N_2=C*VS/7.5;\ \text{and,}$$

(p) engraving the gravure cylinder according to $N_2$ and θ.

6. The method according to claim 5 wherein the first ratio is less than 0.5 or greater than 1.1.

7. The method according to claim 5 wherein said particles have a predetermined diameter in the range of 1 micron to about 25 microns.

8. The method according to claim 5 wherein said particles have a predetermined diameter in the range of 6 microns to 16 microns.

* * * * *